United States Patent [19]

Solaroli

[11] 4,335,818

[45] Jun. 22, 1982

[54] APPARATUS FOR SORTING WORKPIECES OF DIFFERENT CLASSIFICATION CLASSES AND FOR FORMING GROUPS HAVING PRE-SET NUMBER OF WORKPIECES OF THE SAME CLASS

[75] Inventor: Sergio Solaroli, Bologna, Italy

[73] Assignee: Finike Italiana Marposs, S.p.A., S. Marino di Bentivoglio (BO), Italy

[21] Appl. No.: 142,709

[22] Filed: Apr. 22, 1980

Related U.S. Application Data

[63] Continuation-in-part of Ser. No. 18,668, Mar. 8, 1979, abandoned.

[30] Foreign Application Priority Data

Mar. 10, 1978 [IT] Italy ..... 3355 A/78

[51] Int. Cl.[3] ..... B07C 5/16

[52] U.S. Cl. ..... 209/592; 209/933; 209/551

[58] Field of Search ..... 209/592, 593, 594, 595, 209/596, 933, 551; 221/82, 83, 86; 29/156.5 R, 156.5 A, 409, 705, 710

[56] References Cited

U.S. PATENT DOCUMENTS

| | | | |
|---|---|---|---|
| 3,189,178 | 6/1965 | Calleson et al. | 209/551 X |
| 3,300,046 | 1/1967 | Zarkhin et al. | 209/594 |
| 3,313,410 | 4/1967 | Gardner | 209/933 X |
| 3,322,273 | 5/1967 | Bailey | 209/933 X |
| 3,743,090 | 7/1973 | Brown et al. | 209/551 |

*Primary Examiner*—Allen N. Knowles

*Attorney, Agent, or Firm*—Stevens, Davis, Miller & Mosher

[57] ABSTRACT

An apparatus for sorting workpieces of different classification classes and for forming groups having a pre-set number of workpieces of the same class, comprising a base; a housing support mobile on the base having a number of partitions at least equal to the number of classes; a loading device for loading one workpiece at a time into the support partition when in a predetermined loading and unloading position with respect to the support; a control group receiving signals indicative of the class of the workpieces; a control device for operating the housing support, the control device being connected to the control group for positioning in the loading and unloading position a relevant partition provided for receiving the workpieces of the same class of the next workpiece to be loaded; an unloading device arranged in correspondence with the loading position; and a driving device for operating the unloading device, the driving device being connected to the control group and including an enabling mechanism for controlling the unloading at the completion of a group of workpieces of the same class relating to the partition located in the loading and unloading position.

9 Claims, 2 Drawing Figures

Figure 1:
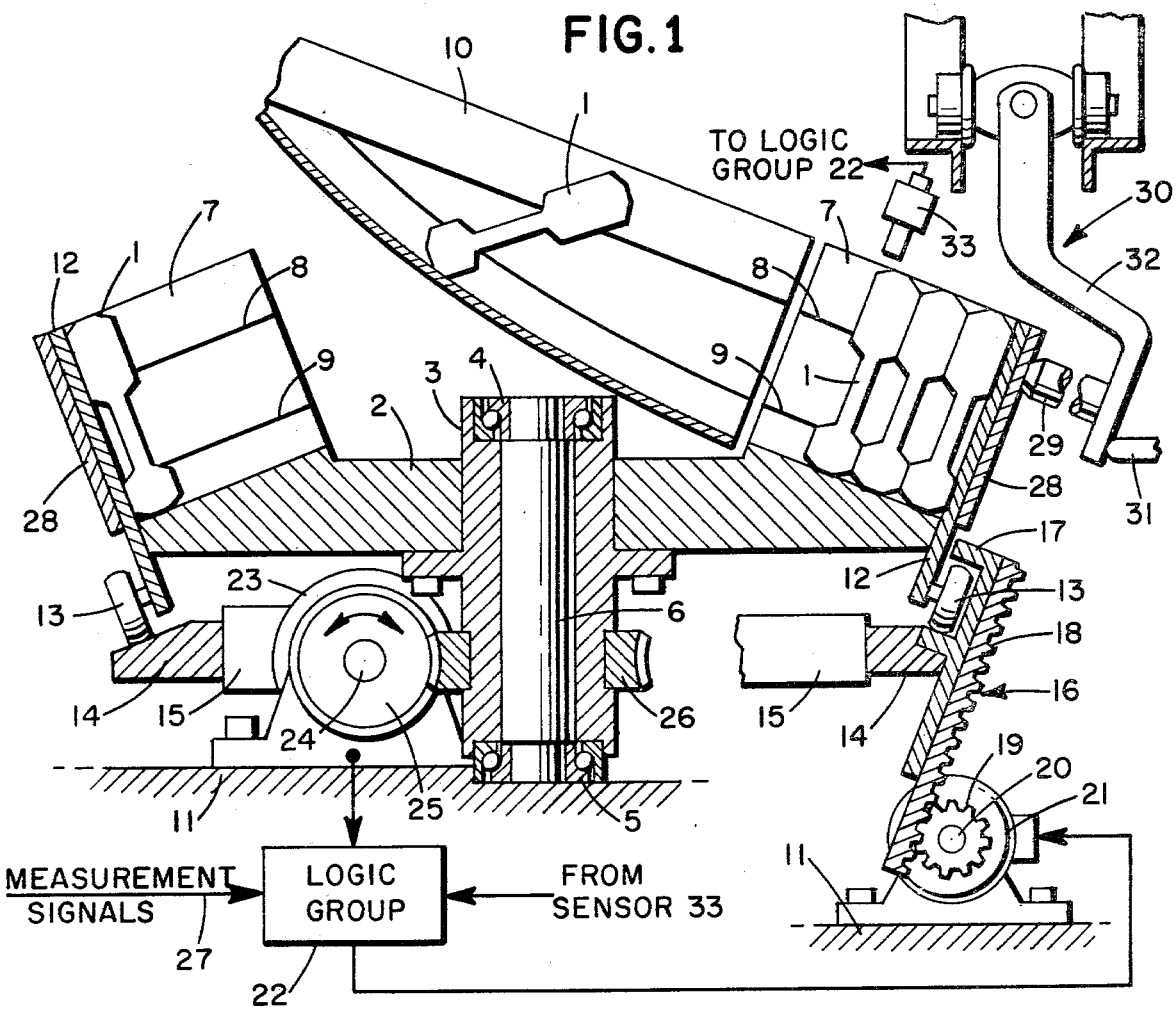

APPARATUS FOR SORTING WORKPIECES OF DIFFERENT CLASSIFICATION CLASSES AND FOR FORMING GROUPS HAVING PRE-SET NUMBER OF WORKPIECES OF THE SAME CLASS

This application is a continuation-in-part of application Ser. No. 018,668 filed Mar. 8, 1979, now abandoned.

The present invention relates to an apparatus for selecting workpieces of different classification classes and for forming groups having a pre-set number of workpieces of the same class.

Particularly, the apparatus relates to selecting and forming groups of automobile engine connecting rods.

It is well known that, in order to have an efficient operation of an automobile engine, the engine must be built assembling workpieces having rather narrow dimensional, geometrical and weight tolerances. Therefore the workpieces for building an engine, after machining and before assembling, are subjected to dimensional, geometrical and weight checks and possibly to other checks, and are classified in different classes depending on their characteristics.

In fact, it is evident that in the assembling of an engine it is not always sufficient to employ just good (within tolerances) workpieces, but it is also necessary—in particular when workpieces must be matched—to classify the workpieces in several tolerance classes and select the workpieces to be used for the same engine.

In particular, the proper operation of an engine requires the use of a group of connecting rods having uniform weight characteristics. For this reason the connecting rods are classified in a plurality of weight classes within tolerance and, for the same engine, a group of connecting rods of the same class is utilized. The number of weight classes within tolerance may be of several tens.

It therefore is an object of the invention to provide an apparatus for sorting workpieces of different classification groups and for automatically forming, for the various classes, groups having a pre-set number of workpieces.

A subordinate object of the invention is to provide an apparatus particularly simple, reliable, flexible, and having limited cost. These and other objects and advantages will become evident from the following description obtained through an apparatus comprising, according to the invention: a base; a housing support mobile on the base, the support being subdivided into a number of partitions at least equal to the number of classes; a loading device for loading one workpiece at a time in a support partition while it is in a loading and unloading position with respect to the support; a control group receiving signals indicative of the class of the workpieces; a control device for operating the housing support, the control device being connected to the control group for positioning in said loading and unloading position a relevant partition provided for receiving the workpieces of the same class of the next workpiece to be loaded; an unloading device arranged to correspond with said loading position; and a driving device for operating the unloading device, the driving device being connected to the control group, and including enabling means for controlling the unloading at the completion of a group of workpieces of the same class relating to the partition located in said loading and unloading position.

Figure 2:
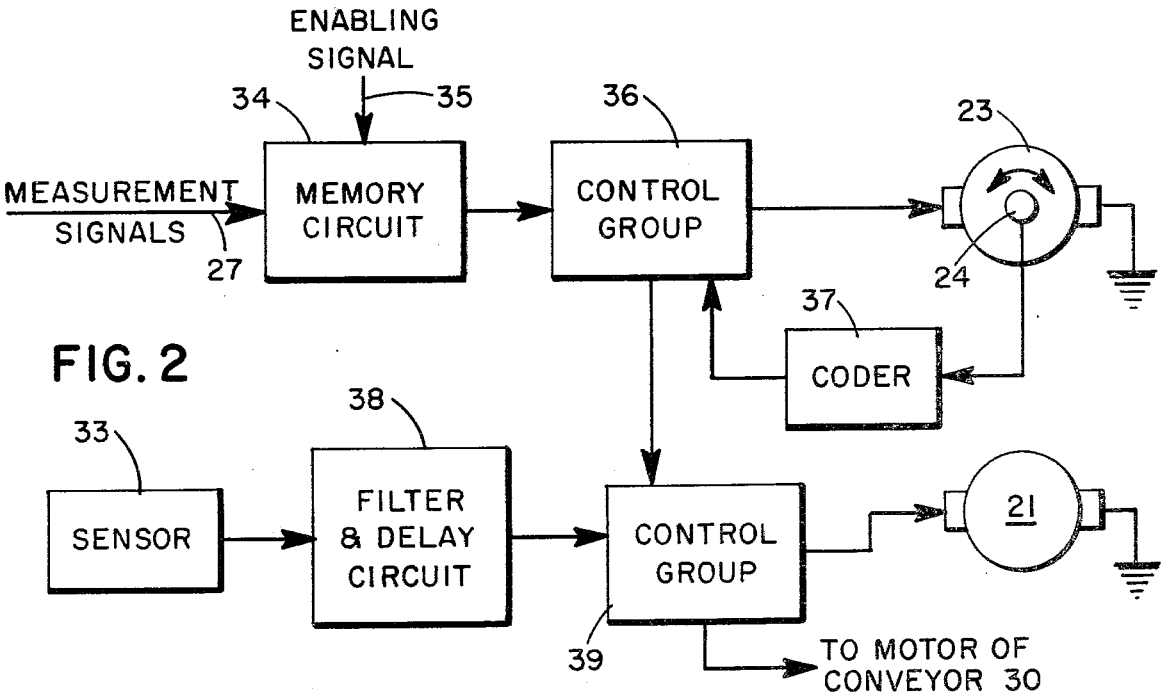

The invention will be described hereinafter in more detail with reference to the accompanying drawings given for indicative and not limiting purpose, in which:

FIG. 1 is a simplified vertical cross-section of an apparatus according to a preferred embodiment of the invention; and FIG. 2 is a block-diagram relating to the circuits and control devices and to the operation of the apparatus of FIG. 1.

The apparatus shown in FIG. 1 comprises a support for housing the workpieces, which consist of automobile engine connecting rods 1. The support is constituted by an indexing fixture 2 fixed to a hub 3 which revolves through bearings 4, 5, about a vertical spindle 6.

A plurality of partitions 7 is positioned on indexing fixture 2; each partition 7 housing a group of connecting rods 1 of the same class. For the illustrated apparatus each group is formed by four connecting rods.

Partitions 7 have vertical walls arranged radially and longitudinal geometrical axes arranged according to the generatrices of a conical surface coaxial with spindle 6. Guides 8, 9 are fixed to the walls of partitions 7 for gravitationally sliding the rods. These guides permit the connecting rods 1 to stack on each other with the longitudinal axes perpendicular to the geometrical longitudinal axis of the relevant partition 7.

Another guide 10 for gravitationally sliding the rods is fixed to base 11 and provides for the loading of connecting rods 1 into indexing fixture 2. Guide 10 directs the connecting rods towards the partition 7 which is located in the loading and unloading position corresponding to the position of the partition 7 on the right side of the figure. In fact, as it may be noticed, the sliding axis of the connecting rods coming out of guide 10 coincides with the longitudinal geometrical axis of the partition 7 shown on the right.

Partitions 7 are closed by shutter doors 12 sliding in guides, not shown, mounted on indexing fixture 2 and in the base 11 of the apparatus. Doors 12 carry relevant rollers 13. Rollers 13 (apart from the roller carried by the door of the partition being in the loading and unloading position) contact a stop ring 14 supported by brackets 15 of base 11, so that doors 12 are prevented from opening.

Ring 14 has a gap corresponding to the radial position (with respect to spindle 6) for loading and unloading connecting rods 1. In this position there is arranged an opening-closing device 16 acting on the door 12 of the partition located in the loading and unloading position.

The opening-closing device 16 comprises a C-shaped element 17. The lower side of element 17 is aligned, in its closure position, with the stop surface of ring 14. Element 17 is fixed to a rack 18 axially movable on guides, not shown, fixed to base 11. Rack 18 meshes with a pinion 19 keyed onto the shaft 20 of a motor 21 electrically connected to a logic group 22. Group 22 is also connected to a motor 23 having a shaft 24 with a worm-screw 25 meshing with a helical gear 26 keyed onto hub 3.

Moreover, group 22 receives at an input 27 the measurement signals from an inspection and marking machine, not shown, arranged upstream of the apparatus according to the invention. The inspection and marking machine carries out the weight checks on the connecting rods 1 and marks on the rods codes indicative of the respective weight classes. The apparatus according to the invention subsequently sorts and stacks the connecting rods in groups of four pieces, depending on said measurement signals.

Plates 28 are fixed to doors 12. The plates, in the loading and unloading position, are in contact with the end of a pin 29 of a conveyor 30 which moves the connecting rods towards stations for the assembling of the automotive engines.

A stop 31 limits the amplitude of the rotary movement of an arm 32, carrying pin 29, when loading a group of connecting rods onto pin 29.

A proximity sensor 33, connected to group 22, is arranged in correspondence with the position for loading and unloading connecting rods 1. Sensor 33 provides an enabling signal which causes the operation of motor 21 when partition 7 positioned for receiving a connecting rod of the relevant weight class has present a number of connecting rods equal to the group number minus one, and therefore equal to three for the described apparatus.

Group 22 and the operation of the apparatus will be now described in detail with reference to the block diagram in FIG. 2.

The signal indicative of the weight class of a previously checked connecting rod 1 being loaded onto guide 10 is memorized by a memory circuit 34. Circuit 34 automatically updates when receiving the signal itself, through an enabling signal received at a terminal 35 from the inspection and marking machine.

Memory circuit 34 is connected to a control group 36 controlling motor 23. Control group 36 receives from a coder 37 a signal indicative of the position of shaft 24 and therefore of indexing fixture 2.

The signal indicative of the weight class and that indicative of the shaft 24 position are compared and a signal resulting from the comparison controls rotation of shaft 24 in clockwise or counterclockwise direction, positioning in the loading and unloading position partition 7 provided for housing the connecting rods having the corresponding weight class.

When connecting rod 1, sliding due to gravity, reaches the output of guide 10, partition 7 is in position to receive it.

When sensor 33, before the arrival of connecting rod 1, detects the presence in partition 7 of three connecting rods (being, of course, of the same weight class of the arriving connecting rod), a signal is obtained—through a filter and delay circuit 38 and a control group 39 of motor 21—which controls lowering of rack 18. Filter and delay circuit 38 prevents the generation of control signals in consequence of disturbances or of the rapid passage of the connecting rods at sensor 33.

Control group 39 is also connected to group 36, from which it receives an enabling signal indicative of the imminent arrival of a further connecting rod to the partition 7 already positioned. Element 17, moving downwardly together with rack 18, opens shutter door 12. Thereafter the three connecting rods present in partition 7, move out from partition 7—followed by the fourth connecting rod—due to their own weight or in consequence of the impact of the fourth connecting rod. The four connecting rods insert onto pin 29. Then rack 18 rises closing door 12. A signal issued from an output 40 of group 39 controls the operation of a motor, not shown, which starts conveyor 30. Then conveyor 30 moves the group of four connecting rods towards the stations for the assembling of the automotive engine.

The apparatus further includes synchronizing, control, enabling and safety circuits which assure, among other things, synchronization with the inspection and marking machine and with conveyor 30. These circuits are not shown to prevent unnecessary complication of the description and of the drawings and in consideration of the fact, too, that depending on the particular applications they can be easily constructed by a normal technician.

As it appears from the preceding disclosure, the time necessary to form a group of connecting rods at the apparatus output is considerably shortened because the opening of door 12 is controlled before the last connecting rod of the group reaches partition 7. Another advantage of the apparatus consists in the possibility of using logic circuits particularly simple, without negatively affecting the times for sorting and forming groups of connecting rods.

It is evident that the apparatus may be modified for sorting and forming groups of workpieces different from connecting rods and that other changes equivalent from a functional and constructional point of view can be made without going outside of the scope of the invention.

What is claimed is:

1. An apparatus for sorting workpieces of different classification classes and for forming groups having a pre-set number of workpieces of the same class, comprising a base; a housing support mobile on the base having a number of partitions at least equal to the number of classes; a loading device for loading one workpiece at a time into the support partition when in a determined loading and unloading position with respect to the support; a control group receiving signals indicative of the class of the workpiece; a control device for operating the housing support, the control device being connected to the control group for positioning in the loading and unloading position a relevant partition provided for receiving the workpieces of the same class of the next workpiece to be loaded; an unloading device arranged in correspondence with the loading position; and a driving device for operating the unloading device, the driving device being connected to the control group and including enabling means for controlling the unloading at the completion of a group of workpieces of the same class relating to the partition located in the loading and unloading position.

2. The apparatus according to claim 1, wherein said enabling means are adapted to provide an enabling signal for the operation of the unloading device at the detection of the presence, in the partition positioned in said loading and unloading position for receiving a workpiece from said loading device, of a number of workpieces equal to said pre-set number minus one.

3. The apparatus according to claim 1 or claim 2, wherein said housing support comprises a rotatable indexing fixture.

4. The apparatus according to claim 1 or claim 2, wherein said loading device includes a guide for gravitationally sliding said rods.

5. The apparatus according to claim 1 or claim 2, wherein said partitions comprise closure doors and said unloading device comprises an opening device for opening the closure door of the partition located in said loading and unloading position.

6. The apparatus according to claim 5, wherein said enabling means include a sensor arranged to detect the presence of a number of workpieces equal to said pre-set number minus one, for controlling the opening of the closure door of the partition located in the loading and unloading position.

7. The apparatus according to claim 6, wherein said closure doors are of the shutter type and including a stop on said base for keeping closed the doors, the stop defining a gap therein corresponding to said loading and unloading position, the unloading device comprising a mobile stop for permitting the opening of the door of the partition located in the loading and unloading position.

8. The apparatus according to claim 7, wherein said doors carry rollers adapted to cooperate with said stops.

9. The apparatus according to claim 4, for sorting and forming groups of connecting rods, wherein said housing support with partitions comprises a rotatable indexing fixture and said guide for gravitationally sliding defines a geometrical axis inclined with respect to a horizontal plane, said partition being adapted to receive and guide the connecting rods with the axes of the connecting rods placed side by side, the partitions of the indexing fixture defining geometrical axes lying along the generatrices of a conical surface, the axis of the conical surface coinciding with the rotational axis of the indexing fixture, the axis of the partition located in said loading and unloading position coinciding with the geometrical axis of said guide for gravitational sliding.

* * * * *